US005879849A

United States Patent [19]

Sawada et al.

[11] Patent Number: 5,879,849

[45] Date of Patent: Mar. 9, 1999

[54] DEVELOPING DEVICE USING ONE COMPONENT DEVELOPER

[75] Inventors: Akira Sawada, Fujisawa; Kanjiroh Kawasaki; Shinichiro Yagi, both of Numazu, all of Japan

[73] Assignee: Ricoh Company, Ltd., Tokyo, Japan

[21] Appl. No.: 882,214

[22] Filed: Jun. 25, 1997

[30] Foreign Application Priority Data

Jul. 1, 1996 [JP] Japan ..... 8-191521

[51] Int. Cl.[6] ..... G03G 9/097; G03G 15/08

[52] U.S. Cl. ..... 430/110; 430/903; 399/265

[58] Field of Search ..... 430/110, 903

[56] References Cited

U.S. PATENT DOCUMENTS

| | | | |
|---|---|---|---|
| 5,482,805 | 1/1996 | Grande et al. | 430/110 |
| 5,705,306 | 1/1998 | Kitani et al. | 430/110 |

FOREIGN PATENT DOCUMENTS

| | | |
|---|---|---|
| 63-42787 | 8/1988 | Japan . |
| 64-10269 | 1/1989 | Japan . |
| 02-60179 | 12/1990 | Japan . |
| 04-127177 | 4/1992 | Japan . |
| 04-293058 | 10/1992 | Japan . |
| 04-335357 | 11/1992 | Japan . |
| 07-191500 | 7/1995 | Japan . |

*Primary Examiner*—Roland Martin
*Attorney, Agent, or Firm*—Oblon, Spivak, McClelland, Maier & Neustadt, P.C.

[57] ABSTRACT

A developing device using one component developer for developing an electrostatic latent image on a photoconductive drum. The one component developer includes particles of parents of toner, resin beads and silica. The silica adhere to a surface of each resin bead. The resin beads and the silica further adhere to a surface of the parents of toner. A volume average diameter of the resin beads is more than that of the silica and is less than that of the parents of toner.

16 Claims, 4 Drawing Sheets

DEVELOPING DEVICE USING ONE COMPONENT DEVELOPER

BACKGROUND OF THE INVENTION

1. Field of the Invention

The present invention relates to an image forming apparatus such as a copier, a printer, a facsimile machine or a similar electrophotographic image forming apparatus. More particularly, the present invention relates to a developing device which uses one component developer utilized in such image forming apparatuses.

2. Discussion of the Background

A developing device which uses one component developer is favorable for miniaturization and to decrease cost. In order to avoid deformation of a developing roller, wearing of a surface of a developing roller and forming a ghost and to reduce torque, a non-contacting type developing device in which toner on a surface of a developing roller jumps across a distance between a surface of a developing roller and a surface of a photoconductive drum is favorable.

In a background one component and non-contacting type developing device, if a cohesive force of toner is high, an adhesive force between the toner and a surface of a developing roller and between toner particles is high. As a result, it is difficult to transfer toner from the surface of the developing roller to a surface of a photoconductive drum, and therefore image density becomes low and gradations of an intermediate density of the image become poor.

In order to improve liquidity of toner, Japanese-Publication No. 63-42787 discloses a one component developing device in which additives such as silica are added to the toner. Silicon carbide or titanium oxide are also usable as additives.

Further, in a background one component developing device, it is difficult to carry enough toner on a developing roller, and therefore image density becomes poor.

In order to solve such problems, Japanese Laid-Open Patent No. 4-127177 discloses a developing device in which small size electric conductive portions which are grounded and dielectric portions are provided on a surface of a developing roller. Toner and the dielectric portions are triboelectrically charged at a contact portion between a developing roller and a toner supply roller which moves relative to the developing roller. A large number of minute electric fields are formed on a surface of the developing roller by charging the dielectric portions, and therefore charged toner is adhered to the surface of the developing roller for carrying the developer, and a few toner layers are formed on the developing roller.

The present inventors have conducted experiments on a developing roller which was the same as the developing roller of the Japanese Laid-Open Patent No. 4-127177 and on developer which was the same as the developer of the Japanese Publication No. 63-42787. As a result of the experiments, the present inventors determined that a density of the toner became poor after a large number of image operations were executed. The cause of the problem is that since additives which increase the liquidity of the developer are harder than parents of toner (i.e., base toner particles) such as styrene-acrylic resin and polyester resin, the additives are buried in the parents of toner while the developer is mixed by an agitator in a developer container, and therefore toner which is not developed increases. Further, an adhesive force between the toner and a developing roller increases since the parents of toner are held in direct contact with the developing roller, and as a result the toner adheres to the developing roller. Especially, since the developing roller of the Japanese Laid-Open Patent No. 4-127177 has a strong adhesive force to toner, it is difficult to transfer toner to a photoconductive drum.

Japanese Publication No. 2-60179 discloses a developer in which resin particles having an average diameter from 0.1 μm to 2 μm are added to the developer from 0.01 to 10 weight-% to increase an ability of triboelectric charge of the toner. The ability of the triboelectric charge of the toner becomes poor if grinding particles such as silica are added to the developer to avoid toner filming from occurring on a surface of a photoconductive drum. According to the experiments by the present inventors, it was difficult to obtain enough liquidity and enough developing efficiency even if developer which includes resin particles was used in the one component and non-contact type developing device.

SUMMARY OF THE INVENTION

Accordingly, it is an object of the present invention to provide a novel developing device in which an image density remains high even after a large number of image formation operations are executed.

In order to achieve the above-mentioned object, according to the present invention, a developing device utilizes one component developer for developing an electrostatic latent image on an image bearing member. The one component developer includes parents of toner, first additive particles and second additive particles which may adhere to the surface of each first additive particle. Further, the first additive particles and the second additive particles may adhere to a surface of the parents of toner particles.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 1(*b*) is a schematic representation showing the one component developer of the present invention;

FIG. 1(*c*) is a schematic representation showing the one component developer of the present invention that is agitated;

FIG. 8(*b*) shows the background one-component developer that is agitated.

DESCRIPTION OF THE PREFERRED EMBODIMENTS

Figure 1A:
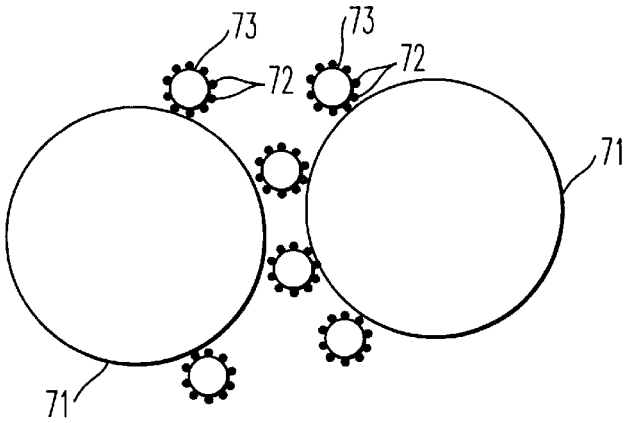
FIG. 1(*a*) is a schematic representation showing one component developer of the present invention.
Figure 1B:
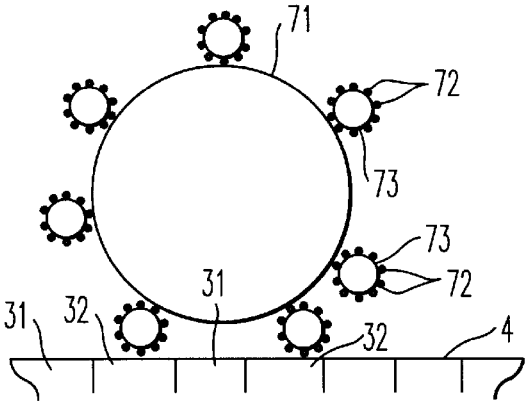
Figure 1C:
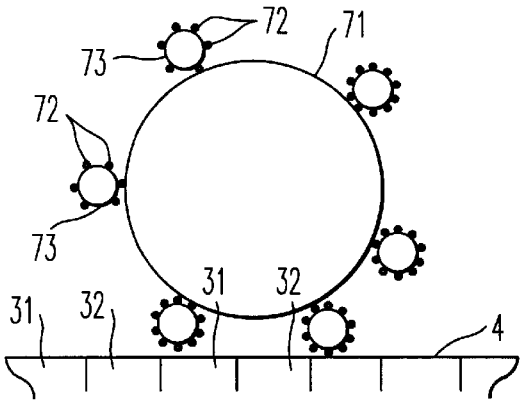

Referring now to the drawings, wherein like reference numerals designate identical or corresponding parts throughout the several views, and more particularly to FIG. 1(*a*) thereof, one component developer of the present invention which includes particles of parents of toner 71 and additives 72 and 73 which cover a surface of the parents of toner 71 is shown. The additives includes first additives 73 and second additives 72 which cover a surface of the first additive 73. The parents of toner 71 are not held in contact with a surface of a developing roller 4 as shown in FIG. 1(*b*) and/or are not held in contact with another parent of toner as shown in FIG. 1 (*a*). As a result, an adhesive force between the parents of toner 71 and the developing roller 4 or between one parent of toner particle 71 and another parent of toner particle 71 are reduced. Since the adhesive force between the parents of toner 71 and the developing roller 4 is reduced, the one component developer on the developing roller 4 can easily move to a photoconductive member, and therefore developing efficiency is increased. Since the adhesive force between one parent of toner particle 71 and another parent of toner particle 71 is reduced, liquidity of the one component developer is increased. Further, the first additives 73 act as shock absorbers between the parents of toner 71 and the second additives 72. As a result, the first additives 73 act as shock absorbers to prevent the second additives 72 from being buried in the parents of toner 71, and therefore liquidity of the one component developer is maintained for a long time.

Figure 2:
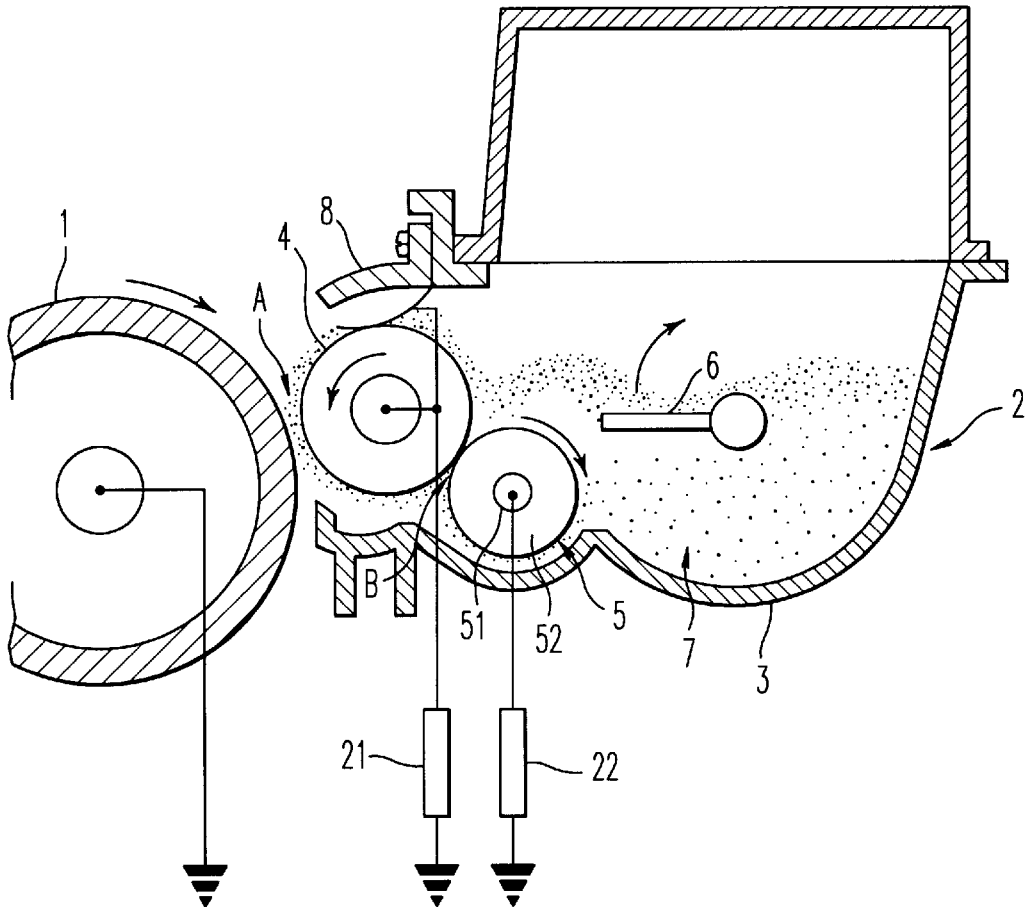
FIG. 2 is a sectional view of a one component developing device of the present invention.

In FIG. 2, a non-contacting type one component developing device embodying the present invention is shown and includes a photoconductive drum 1 which rotates in a direction indicated by an arrow at, as an example, a linear velocity of 200 mm/sec. A developing device 2 is disposed adjacent to the photoconductive drum 1. A charger, exposing optical devices, a transferring charger, a separate charger, a cleaning device and a discharging device (all not shown) are typically located around the photoconductive drum 1.

The developing device 2 includes a casing 3 having an opening which faces the photoconductive drum 1 and includes a developing roller 4 which rotates in a counterclockwise direction. Further, the developing device 2 includes a toner supply roller 5 having a surface which is held in pressured contact with the developing roller 4 and which rotates in a direction indicated by an arrow. An agitator 6 transports one component developer and toner 7 which is stored in a hopper to the toner supply roller 5, and agitates the toner 7 in the hopper. A blade 8 regulates a thickness of the toner 7 on the developing roller 4 before the toner 7 is transported to a developing area A.

The developing roller 4 is disposed such that a surface of the developing roller 4 faces a surface of the photoconductive drum 1 at a small distance to execute a non-contacting type developing operation. The developing roller 4 rotates such that the surface of the developing roller 4 moves in a same direction and with a same linear velocity, e.g., 200 mm/sec, as the surface of the photoconductive drum 1 at the developing area A. A power source 21 applies a developing bias voltage, such as a DC bias voltage, an AC bias voltage, an AC bias voltage superimposed on a DC bias voltage or a pulse voltage, to the developing roller 4. It is also possible to apply the developing bias voltage from the power source 21 to the blade 8.

A surface of the developing roller 4 may include small size electric conductive portions 31 which are grounded and dielectric portions 32, see FIG. 1. The dielectric portions 32 are triboelectrically charged at a nip portion between the developing roller 4 and the toner supply roller 5 and a large number of minute electric fields are formed on the surface of the developing roller 4. A diameter of each dielectric portion 32 may be from 50 $\mu$m to 200 $\mu$m and dielectric portions 32 may be provided on a surface of the developing roller 4 at random. It is also possible to provide the dielectric portions 32 regularly. A ratio of an area of the dielectric portions 32 to the surface of the developing roller 4 may be from 40% to 70%. A material of the dielectric portions 32 may be selected from materials that do not store an electric charge generated by triboelectric charge between the developing roller 4 and the toner supply roller 5. The developing roller 4 may be made by the following method. Namely, grooves are formed on a surface of an electric conductive core roller by a knurling processing, and then the surface of the core is coated with an insulated resin, and finally the surface of the core is scraped. As a result, the core portions corresponding to the electric conductive portions 31 and the insulated resin corresponding to the dielectric portions 32 which are filled up in the grooves are exposed on the surface of the developing roller 4. In the present embodiment, the developing roller is referred to as an MF (Micro Field) developing roller.

The toner supply roller 5 may include a conductive core 51 and an electric conductive elastic foam layer 52 which has a plurality of holes to carry the toner 7. A material of the elastic foam layer 52 may be a material of which a triboelectric series is intermediate between the toner 7 and the dielectric of the surface of the developing roller 4 to charge the toner 7 and the surface of the developing roller 4. The toner supply roller 5 is held in pressured contact with the developing roller 4 to form a nip portion B between the rollers 4 and 5. A surface of the toner supply roller 5 moves in a same direction as the surface of the developing roller 4 at the nip portion B. The linear velocity of the toner supply roller 5 may be about 0.5 to 2.0 times that of the developing roller 4. A power source 22 applies a bias voltage to the core 51. The bias voltage to the core 51 may be a same as the voltage that is applied to the developing roller 4. It is also possible to apply the bias voltage to the core 51 such that the triboelectrically charged toner 7 on the toner supply roller 5 moves to the developing roller 4 by an electric field formed by the bias voltages.

The agitator 6 rotates in a direction indicated by an arrow. The toner 7 in the hopper is supplied to the toner supply roller 5 and is agitated in the hopper. It is also possible to remove the agitator 6 if the toner 7 can be moved to the toner supply roller 5 by its own weight.

The blade 8 regulates a toner layer on the surface of the developing roller 4 and at that time also charges the toner 7. A material of blade 8 may be a material of which a triboelectric series is intermediate between the toner 7 and the dielectric of the surface of the developing roller 4 to charge the toner 7.

In operation, the toner 7 in the hopper is supplied to the toner supply roller 5 by the agitator 6. The toner 7 is carried on the surface and in the holes of the elastic foam layer 52, and is then transported to the nip portion B between the toner supply roller 5 and the developing roller 4. The toner 7 is rubbed between the toner supply roller 5 and the developing roller 4 at the nip portion B, and therefore the toner is triboelectrically charged to a negative polarity that is a same polarity as the electric charge of the photoconductive drum 1. In the present embodiment, since exposed areas on the photoconductive drum 1 are developed by a reverse developing method, the toner 7 is charged to the same polarity as the photoconductive drum 1. It is also possible to charge the toner 7 to an opposite polarity as the electric charge of the photoconductive drum 1 if the charged areas on the photoconductive drum 1 are developed by a regular developing method.

The dielectric portions 32 on the surface of the developing roller 4 are charged to a positive polarity by a rub between the toner supply roller 5 and the developing roller 4 at the nip portion B, and therefore minute closed electric fields are formed on the surface of the developing roller 4. If the regular developing method is adopted, the dielectric portions 32 must be charged to a negative polarity. The charged toner 7 on the toner supply roller 5 is electrically adhered to the surface of the developing roller 4 at the nip portion B by the minute closed electric fields so as to form more than one toner layer on the surface of the developing roller 4. The toner layers formed on the surface of the developing roller 4 are regulated by the blade 8 to form a uniform thickness overall toner layer, and the uniform thickness overall toner layer is transported to the developing area A. The toner on the surface of the developing roller 4 is then transferred to the photoconductive drum 1 at the developing area A. After the developing operation, residual toner is removed from the surface of the developing roller 4 by toner supply roller 5. At the same time, the developing roller 4 is triboelectrically charged by the rub between the developing roller 4 and the toner supply roller 5 to refresh the electric charge on the surface of the developing roller 4.

The toner 7 includes the particles of parents of toner 71 and first and second additives 73 and 72 which cover the surface of the parents of toner 71 as shown in FIG. 1. In the present embodiment, resin beads, each of which has a spherical shape, can be used as the first additives 73 and silica can be used as the second additives 72. Since the first additives 73, which are covered by the second additives 72, are formed on the parents of toner 71, liquidity of the toner 7 and developing ability is maintained. It has been determined by the present inventors by many experiments and by examining the toner 7 with a microscope that these abilities are related to a diameter of the additives, a quantity of additives, and so on.

Diameter of Resin Beads as First Additives 73

It is desirable that each resin bead has a volume average diameter of 0.1 $\mu$m to 1.0 $\mu$m. The diameter of each of the resin beads is related to forming a thin toner layer and to developing ability. If the diameter of each of the resin beads is too small, adjacent parents of toner 71 particles may be held in direct contact with each other. The parents of toner 71 and the developing roller 4 may also be held in direct contact each other. If the diameter of each of the resin beads is too large, the resin beads may behave like toner and they may adhere to the developing roller 4 instead of adhering to the parents of toner 71.

Figure 3:
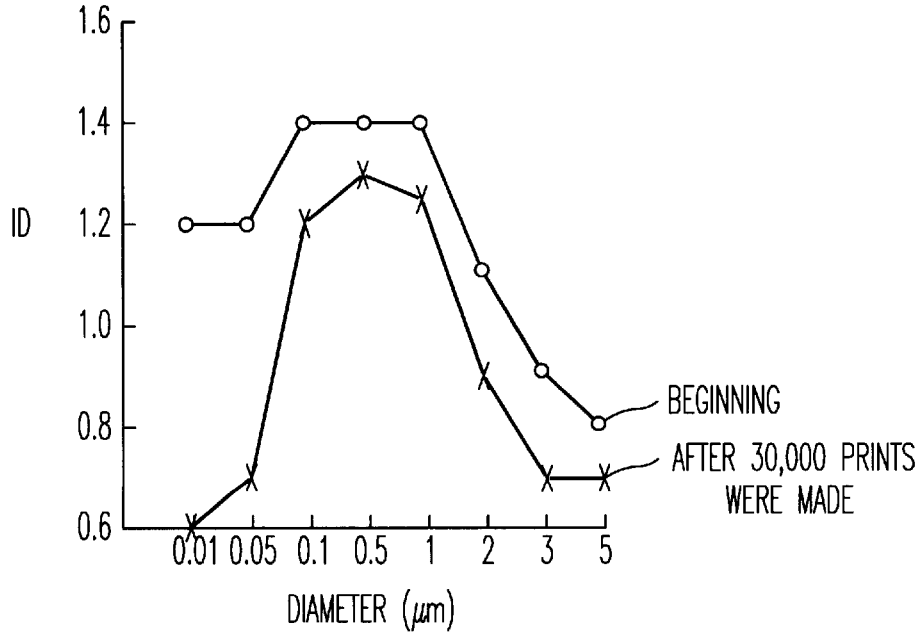
FIG. 3 is a graph showing a relationship between diameters of resin beads and image density.

FIG. 3 shows a relationship between the volume average diameter of resin beads and image density. In FIG. 3, the line including circles shows the beginning image density and the line including crosses shows image density after 30,000 prints were made. In an experiment conducted by the present inventors, silica of 0.7 weight-% as second additives 72 and resin beads of 1.0 weight-% as first additives 73 were added to a one component developer.

At the beginning, when the volume average diameter of the resin beads was less than 0.1 $\mu$m, the image density was 1.2, which was a same density as when the resin beads were not added. When the volume average diameter of the resin beads was from 0.1 $\mu$m to 1 $\mu$m, the image density was 1.4 since the resin beads were mixed with silica well, and therefore the toner was transferred from the developing roller 4 to the photoconductive drum 1 easily. When the volume average diameter of the resin beads was more than 1 $\mu$m, the image density was from 0.8 to 1.1 since the toner layer on a surface of a developing roller 4 was not uniform.

After 3,000 prints were made, when the volume average diameter of the resin beads was less than 0.1 $\mu$m, the image density was not more than 0.7 since the resin beads adhered to the surface of the developing roller 4 and a part of the adhered resin beads formed a filming layer. When the volume average diameter of the resin beads was from 0.1 $\mu$m to 1 $\mu$m, the image density was not less than 1.2 since the silica was not buried in the parents of toner 71 and since the mixture of the silica and the resin beads covered the parents of toner 71. When the volume average diameter of the resin beads was more than 1 $\mu$m, the image density was 0.7 since the resin beads were separated from the parents of toner 71 and the silica was buried in the parents of toner 71.

Relationship Of Diameter Between Silica And Resin Beads

It is desirable that the volume average diameter of the resin beads is from 2 to 7 times as large as the silica of which volume average diameter is not more than 0.1 $\mu$m. Essentially, since the adhesive force between the resin beads and the toner 7 and between the resin beads and the surface of the developing roller 4 is very strong, liquidity of toner is poor and a developer transferring ratio is about 30% even if the resin beads are added to the parents of toner 71.

As a result of experiments by the present inventors, it was determined that in the toner 7 utilizing the resin beads as the first additives 73, each of which was covered by silica as the second additives 72, to cover the parents of toner 71 was good for image density and developer transferring ratio.

Figure 4:
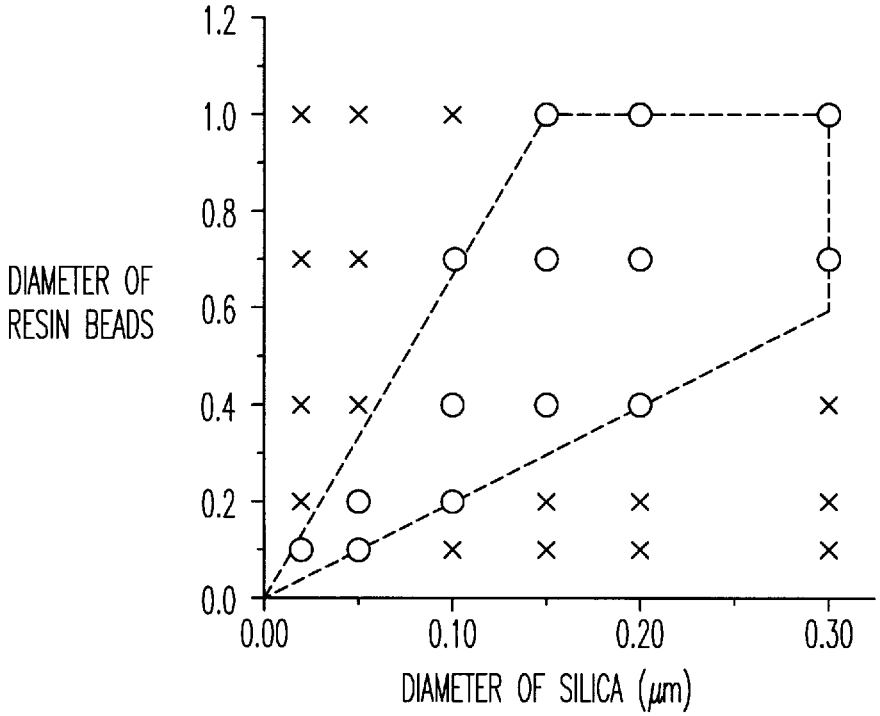
FIG. 4 is a graph showing an evaluated result of image density corresponding to a diameter of additives.

In order to obtain such a beneficial toner it is essential that the silica adheres to the resin beads securely. If the silica is larger than the resin beads, the silica separates from the resin beads easily. From this point of view, the present inventors presumed that a relationship of the diameters between the silica and the resin bead influences adhesion. Therefore, the present inventors conducted an experiment about the relationship of the image density, the volume average diameter of the silica and that of the resin beads. In this experiment, silica of 0.7 weight-% and resin beads of 1.0 weight-% were mixed with the parents of toner 71. FIG. 4 shows the results of the experiment. In FIG. 4, a circle shows that the image density was not less than 1.2 and a cross shows that the image density was less than 1.2 after 30,000 prints were made. As a result of the experiment, it was determined that if the volume average diameter of the silica and that of the resin beads satisfied the following relationship, the image density was good:

$X \leqq 0.3$, $Y \leqq 1.0$ and $2X \leqq Y \leqq 7X$ where X is the volume average diameter of the silica and Y is the volume average diameter of the resin beads.

Mixing Ratio

Figure 5:
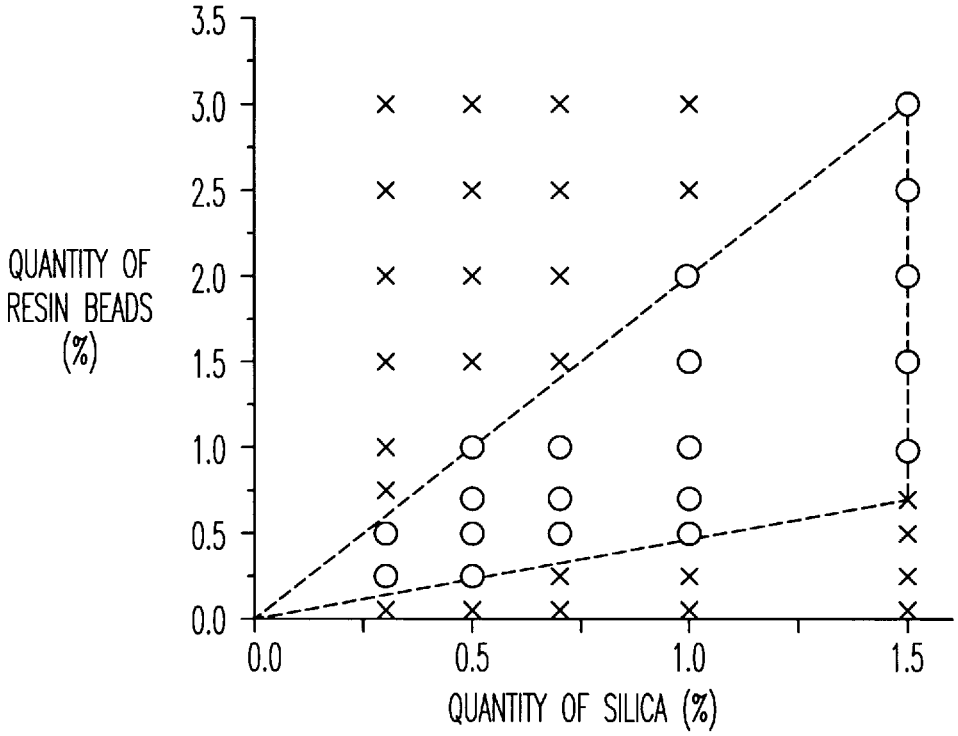
FIG. 5 is a graph showing an evaluated result of image density corresponding to a quantity of additives.

A mixing ration between the silica as the second additives 72 and the resin beads as the first additives 73 is also important to achieve toner with beneficial characteristics. As a result of experiments by the inventors, it was determined that an output image which has a good image density can be made when the quantity of the silica is not more than 1.5 weight-% of the parents of toners 71, and a ratio of the quantity of the resin to that of the silica was from 0.5 to 2 to 1. FIG. 5 shows results of such an experiment. In FIG. 5, a circle shows that the image density was not less than 1.2 and a cross shows that the image density was less than 1.2 after 30,000 prints were made. As a result of the experiment, it was determined that if the quantity of the silica and that of the resin beads satisfied the following relationship, the image density was good:

$X \leqq 1.5$, $Y \leqq 3.0$ and $0.5X \leqq Y \leqq 2X$ where X is the quantity of the silica and Y is the quantity of the resin beads.

Developing Roller 4

As a concrete example, the developing roller 4 may be made by the following method.

Plural quadrilateral grooves having a depth of 0.15 mm, a width of 0.2 mm and a pitch of 0.3 mm are formed in a figured shape on a surface of an electric conductive core having a diameter of 25 mm by a knurling processing. Epoxy denaturation silicone resin (Tore SR2115: Trademark) is coated on a surface of a core and then the roller, the core of which is now coated by the resin, is then dried for about 30 minutes at 100° C. A surface of the roller is shaved so as to expose the core and the resin in the grooves. A size of the core, electric conductive portions 31, to the surface of the roller is 50% and that of the resin, dielectric portions 32, to the surface of the roller is 50%.

Toner Supply Roller 5

An electric conductive elastic foam layer 52 having an electric resistance of $1\times10^6\Omega\cdot$cm is formed on an electric conductive core 51 having a diameter of 8 mm to form a sponge roller having a diameter of 16 mm. The sponge roller is disposed such that it is held in pressured contact with the developing roller 4 and such that the surface of the elastic foam layer 52 is compressed about 1 mm. The electric conductive elastic foam layer 52 is polyurethane foam in which carbon particles are dispersed. The surface velocity of the toner supply roller 5 is 0.6 times as fast as that of the developing roller 4.

Blade 8

A soft elastic plate having a thickness of 2 mm, a rubber hardness of 73° and a Young's ratio of 0.66 g/mm$^2$ is held in contact with the surface of the developing roller 4 at an angle of 90° and at a pressure force of 10 to 30 N/m. The soft elastic plate is made of urethane rubber.

Power Source 21 and Developing Gap

A DC bias voltage of −800 V is applied to the developing roller 4. A distance between the surface of the photoconductive drum 1 and that of the developing roller 4 is 150 $\mu$m.

Photoconductive Drum 1

An organic photoconductive (OPC) drum is used as the photoconductive drum 1 having a surface charged such that a voltage of a background area is −850 V and that of an exposed area where the toner is transferred is −150 V.

Toner 7

The toner 7 includes the non-magnetic parents of toner 71 particles made of styrene-acrylic resin having a volume average diameter of 11 $\mu$m and including additives. The additives include silica as the second additives 72 of which volume average diameter is 0.1 $\mu$m and in a quantity of 0.7 weight-% and polystyrene beads as the first additives 73 made of polystyrene resin having a volume average diameter of 0.4 $\mu$m and in a quantity of 1.0 weight-%.

Figure 6:
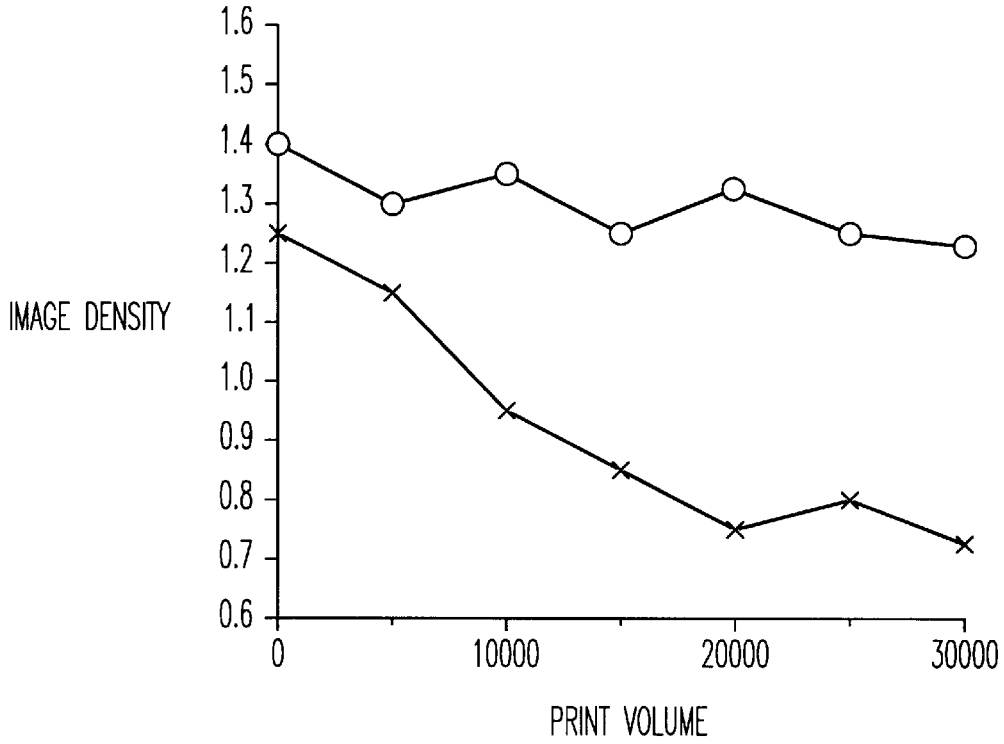
FIG. 6 is a graph showing a relationship between a number of prints and image density.

FIG. 6 shows a change in image density from a start to 30,000 prints. It is difficult to distinguish good image density from bad image density. However according to an inventor's survey, in order to obtain good image density, the image density of a solid image should be not less than 1.2, and more desirably it should be not less than 1.4.

In FIG. 6, the line including circles shows image density when the toner 7 of the present concrete example was used and the line including crosses shows image density when toner in which the resin beads as the first additives 73 were not added to the parents of toner 71, namely the resin beads were removed from the toner 7 of the concrete example.

In FIG. 6, when the toner 7 of the present invention was used, the image density stays greater than 1.2 even after 30,000 prints were made. However, if the toner in which the resin beads were removed was used, the toner density was about 1.2 at the beginning because the toner was hard to separate from the developing roller 4. Further, after the 30,000 prints were made, the image density became less than 0.8.

Figure 7:
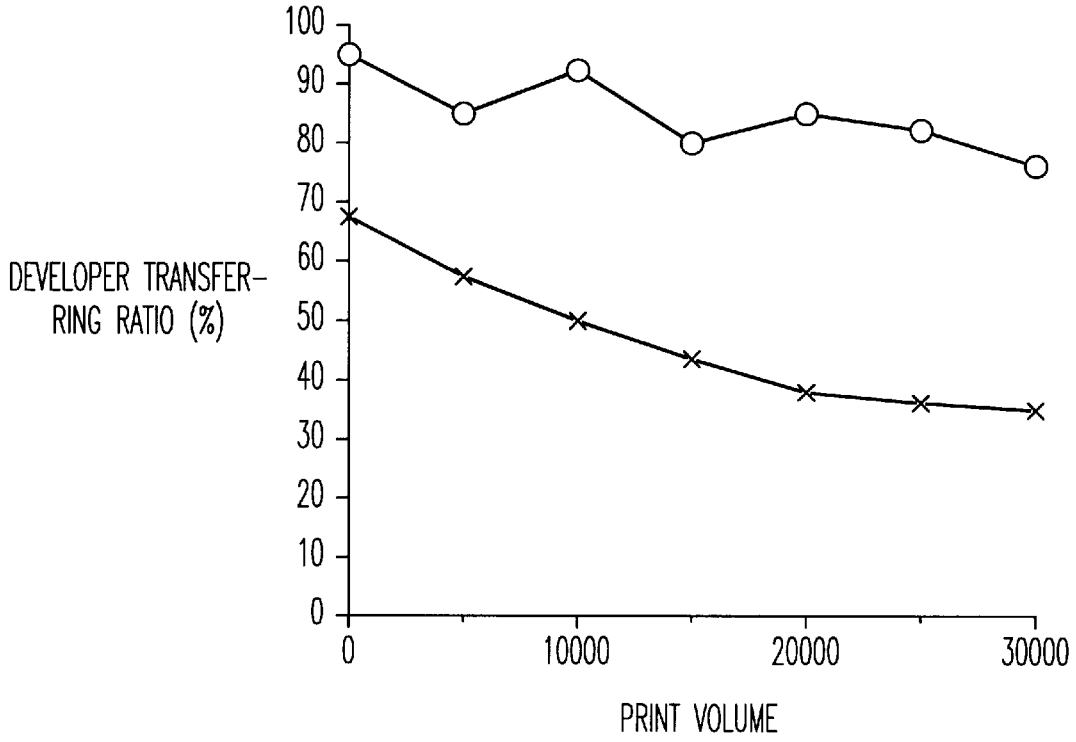
FIG. 7 is a graph showing a relationship between a number of prints and a developer transferring ratio.

FIG. 7 shows a change in the developer transferring ratio according to this experiment. The developer transferring ratio indicates how much toner on the developing roller transfer to the electrostatic latent image of a solid image on the photoconductive drum 1. Namely, the developer transferring ratio is defined by the following equation (1):

$$\text{Developer transferring ratio (\%)}=\{1-(\text{Quantity of Residual Toner on Developing Roller})/(\text{Quantity of Saturated Toner on Developing roller})\}\times100 \quad (1)$$

As shown in FIG. 7, at the beginning, the developer transferring ratio of the toner without the resin beads was about 70%. The reason why the developer transferring ratio was low is that toner of first and second toner layers, among four to five toner layers, that was calculated from the quantity of the toner on the developing roller was not transferred to the photoconductive drum 1 because the MF developing roller 4 had a strong adhesive force for the toner. On the other hand, the developer transferring ratio of the toner with the resin beads was 95% as almost all toner was transferred to the photoconductive drum 1.

After 30,000 prints were made, the developer transferring ratio of the toner without the resin beads as the first additives 73 was 35%. On the other hand, the developer transferring ratio of the toner with the resin beads was more than 75%. The reason why the developer transferring ratio of the toner with the resin beads stays high is the resin beads acted as shock absorbers between the parents of toner 71. As a result, the shock absorbers prevent the silica as the second additives 72 from being buried in the parents of toner 71 as shown in FIG. 1(*a*). After 30,000 prints were made, there were mixtures of the resin beads and the silica around the parents of toner 71. Therefore, the mixtures acted as shock absorbers between the parents of toner 71 themselves and between the parents of toner 71 and the surface of the developing roller 4 as shown in FIG. 1(*c*).

Figure 8A:
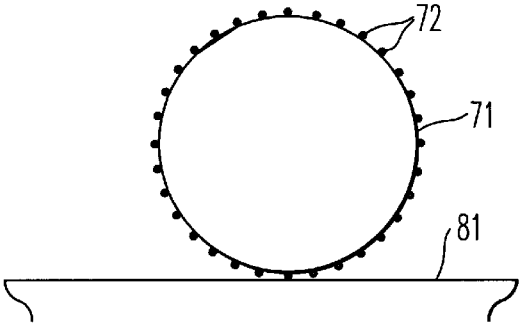
FIG. 8A BACKGROUND ART
FIG. 8(*a*) shows a background one component developer.
Figure 8B:
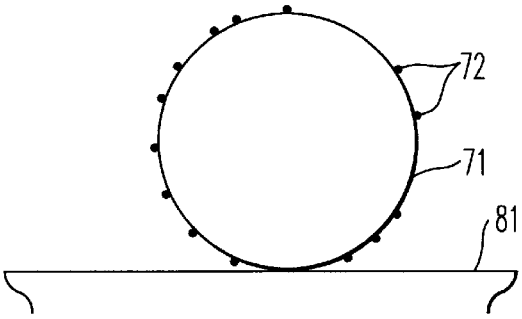
FIG. 8B BACKGROUND ART

When the toner without the resin beads was used, such as in background devices, silica as the second additives 72 was formed between the parents of toner 71 themselves and between the parents of toner 71 and the surface of the developing roller 81 at the beginning as shown in FIG. 8(*a*). However, after 30,000 prints were made, the silica 72 was buried in the parent of toner 71 as shown in FIG. 8(*b*), and therefore liquidity of the toner was not good.

Obviously, numerous additional modifications and variations of the present invention are possible in light of the above teachings. It is therefore to be understood that within the scope of the appended claims, the present invention may be practiced otherwise than as specifically described herein.

The present application is based on Japanese Patent Document 08-191521, the contents of which are incorporated herein by reference.

What is claimed as new and desired to be secured by Letters Patent of the United States is:

1. A developing device using one component developer for developing an electrostatic latent image on an image bearing member, wherein said one component developer comprises:

base of toner particles;

first additive particles; and second additive particles which adhere to a surface of the first additive particles, and wherein said first additive particles and said second additive particles adhere to a surface of the base toner particles.

2. A device as claimed in claim 1, further comprising:

a developer carrying member which carries said one component developer including said base toner particles and said first additive particles and said second additive particles and transports said one component developer to a developing area.

3. A device as claimed in claim 2, wherein:

a volume average diameter of said first additive particles is greater than that of said second additive particles and is less than that of said base toner particles.

4. A device as claimed in claim 2, wherein:

said first additive particles include resin beads of which volume average diameter is 0.1 μm to 1.0 μm and said second additive particles include silica.

5. A device as claimed in claim 2, wherein:

said second additive particles include silica having a volume average diameter less than 0.3 μm, and said first additive particles include resin beads having a volume average diameter 2 to 7 times as large as that of said silica.

6. A device as claimed in claim 4, wherein:

a quantity of said silica is not greater than 1.5 weight-% of said base toner particles, and a ratio of a quantity of said resin beads to that of said silica is from 0.5 to 2 to 1.

7. A device as claimed in claim 2, wherein said developer carrying member includes electric conductive portions and dielectric portions provided on a surface of said developer carrying member, wherein a large number of minute electric field are formed on the surface of said developer carrying member by charging said dielectric portions for carrying said developer.

8. A one component developer for developing an electrostatic latent image comprising:

base of toner particles;

first additive particles; and second additive particles which adhere to a surface of the first additive particles, and wherein said first additive particles and said second additive particles adhere to a surface of the base toner particles.

9. A one component developer as claimed in claim 8, wherein:

a volume average diameter of said first additive particles is greater than that of said second additive particles and is less than that of said base toner particles.

10. A one component developer as claimed in claim 8, wherein:

said first additive particles include resin beads of which volume average diameter is 0.1 μm to 1.0 μm and said second additive particles include silica.

11. A one component developer as claimed in claim 8, wherein:

said second additive particles include silica having a volume average diameter less than 0.3 μm, and said first additive particles include resin beads having a volume average diameter 2 to 7 times as large as that of silica.

12. A one component developer as claimed in claim 10, wherein:

a quantity of said silica is not greater than 1.5 weight-% of said base toner particles and a ratio of a quantity of said resin beads to that of said silica is from 0.5 to 2 to 1.

13. A developing device using one component developer for developing an electrostatic latent image on an image bearing member, wherein said one component developer comprises:

base toner particles;

first additive particles;

second additive particles which adhere to a surface of the first additive particles, and wherein said first additive particles and said second additive particles adhere to a surface of the base toner particles; and a developer carrying member which carries said one component developer including said base toner particles and said first additive particles and said second additive particles and transports said one component developer to a developing area; and wherein said first additive particles include resin beads of which volume average diameter is 0.1 μm to 1.0 μm and said second additive particles include silica;

wherein said second additive particles have a volume average diameter less than 0.3 μm, and said first additive particles have a volume average diameter 2 to 7 times as large as that of said silica;

wherein a quantity of said silica is not greater than 1.5 weight % of said base toner particles, and a ratio of a quantity of said resin beads to that of said silica is from 0.5 to 2 to 1;

wherein said developer carrying member includes electric conductive portions and dielectric portions provided on a surface of said developer carrying member, wherein a large number of minute electric fields are formed on the surface of said developer carrying member by charging said dielectric portions for carrying said developer.

14. A developing device using one component developer for developing an electrostatic latent image on an image bearing member, wherein said one component developer comprises:

base toner particles;

first additive particles;

second additive particles, wherein said first additive particles and said second additive particles adhere to a surface of the base toner particles; and a developer carrying member which carries said one component developer including said base toner particles and said first additive particles and said second additive particles and transports said one component developer to a developing area;

wherein said first additive particles include resin beads of which volume average diameter is 0.1 μm to 1.0 μm and said second additive particles include silica;

wherein said second additive particles have a volume average diameter less than 0.3 μm, and said first additive particles have a volume average diameter 2 to 7 times as large as that of said silica;

wherein a quantity of said silica is not greater than 1.5 weight % of said base toner particles, and a ratio of a quantity of said resin beads to that of said silica is from 0.5 to 2 to 1;

wherein said developer carrying member includes electric conductive portions and dielectric portions provided on a surface of said developer carrying member, wherein a large number of minute electric fields are formed on the surface of said developer carrying member by charging said dielectric portions for carrying said developer.

15. An image forming apparatus which includes a developing device using one component developer for developing an electrostatic latent image on an image bearing member, wherein said one component developer comprises:

base toner particles;

first additive particles;

second additive particles, wherein said first additive particles and said second additive particles adhere to a surface of each base toner particles; and a developer carrying member which carries said one component developer including said base toner particles and said first additive particles and said second additive particles and transports said one component developer to a developing area;

wherein said first additive particles include resin beads of which volume average diameter is 0.1 $\mu$m to 1.0 $\mu$m and said second additive particles include silica;

wherein said second additive particles have a volume average diameter less than 0.3 $\mu$m, and said first additive particles have a volume average diameter 2 to 7 times as large as that of said silica;

wherein a quantity of said silica is not greater than 1.5 weight % of said base toner particles, and a ratio of a quantity of said resin beads to that of said silica is from 0.5 to 2 to 1;

wherein said developer carrying member includes electric conductive portions and dielectric portions provided on a surface of said developer carrying member, wherein a large number of minute electric fields are formed on the surface of said developer carrying member by charging said dielectric portions for carrying said developer.

16. A one component developer for developing an electrostatic latent image comprising:

base toner particles, first additive particles;

second additive particles which adhere to a surface of the first additive particles, and wherein said first additive particles and said second additive particles adhere to a surface of the base toner particles;

wherein said first additive particles include resin beads of which volume average diameter is 0.1 $\mu$m to 1.0 $\mu$m and said second additive particles include silica;

wherein said second additive particles have a volume average diameter less than 0.3 $\mu$m, and said first additive particles have a volume average diameter 2 to 7 times as large as that of said silica;

wherein a quantity of said silica is not greater than 1.5 weight % of said base toner particles, and a ratio of a quantity of said resin beads to that of said silica is from 0.5 to 2 to 1;

wherein said developer carrying member includes electric conductive portions and dielectric portions provided on a surface of said developer carrying member, wherein a large number of minute electric fields are formed on the surface of said developer carrying member by charging said dielectric portions for carrying said developer.

* * * * *